US008774648B2

(12) United States Patent
Ogino

(10) Patent No.: US 8,774,648 B2
(45) Date of Patent: Jul. 8, 2014

(54) IMAGE FORMING APPARATUS WITH DEVELOPER AMOUNT DETECTION

(75) Inventor: Kosuke Ogino, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 75 days.

(21) Appl. No.: 13/415,263

(22) Filed: Mar. 8, 2012

(65) Prior Publication Data

US 2012/0230730 A1 Sep. 13, 2012

(30) Foreign Application Priority Data

Mar. 9, 2011 (JP) ..... 2011-052070

(51) Int. Cl.
*G03G 15/00* (2006.01)

(52) U.S. Cl.
USPC ..... 399/25; 399/26; 399/27; 399/64; 399/119

(58) Field of Classification Search
USPC ..... 399/25, 26, 64
See application file for complete search history.

(56) References Cited

U.S. PATENT DOCUMENTS

| | | | | |
|---|---|---|---|---|
| 4,312,589 | A * | 1/1982 | Brannan et al. | 399/43 |
| 5,491,536 | A * | 2/1996 | Mashiba et al. | 399/59 |
| 5,523,829 | A * | 6/1996 | Miyashiro et al. | 399/396 |
| 5,585,894 | A * | 12/1996 | Araya et al. | 399/114 |
| 5,708,915 | A * | 1/1998 | Noguchi et al. | 399/49 |
| 5,802,419 | A * | 9/1998 | Sakurai et al. | 399/26 |
| 6,944,408 | B2 * | 9/2005 | Holzner | 399/24 |
| 7,505,699 | B2 * | 3/2009 | Harada et al. | 399/27 |
| 8,489,002 | B2 * | 7/2013 | Amann et al. | 399/260 |
| 8,626,005 | B2 * | 1/2014 | Hiraike | 399/27 |
| 2003/0091353 | A1 * | 5/2003 | Hiroshima et al. | 399/25 |
| 2007/0091390 | A1 * | 4/2007 | Kimura et al. | 358/500 |
| 2013/0039668 | A1 * | 2/2013 | Takahashi | 399/25 |
| 2013/0322893 | A1 * | 12/2013 | Suzuki | 399/12 |

FOREIGN PATENT DOCUMENTS

| | | | |
|---|---|---|---|
| JP | 59182472 | A * | 10/1984 |
| JP | 8185094 | A | 7/1996 |
| JP | 2007-57732 | A | 3/2007 |
| JP | 2009-37225 | A | 2/2009 |

OTHER PUBLICATIONS

English translation of Japanese patent document Suzuki et al. (JP 59-182472 A); "Image Forming Device"; published Oct. 17, 1984; by Suzuki, Koji; Nagahira, Joji; Takahashi, Kazuyoshi; Yoshihara, Kunio; Matsui, Toshiaki; Ishikawa, Tadashi.*

* cited by examiner

*Primary Examiner* — David Gray
*Assistant Examiner* — Geoffrey Evans
(74) *Attorney, Agent, or Firm* — Fitzpatrick, Cella, Harper & Scinto

(57) ABSTRACT

An image forming apparatus includes a detachably-mounted cartridge including a developer accommodating portion for accommodating a developer and an operation member, a remaining amount detector for detecting a remaining amount of developer in the developer accommodating portion, an operation amount detector for detecting a cumulative operation amount of the operation member, and a setting device for setting timing of subsequent remaining amount detection of the remaining amount detector. The remaining amount detector provides a remaining amount ratio of the developer remainder to a maximum accommodation capacity of the developer accommodating portion, and the operation amount detector provides an operation amount ratio of a remaining operation amount until the end of the service life from the detection of the cumulative operation amount to a total operation amount until the end of the service life from an initial state of the operation member. The setting device sets the timing on the basis of a comparison between the remaining amount ratio and the operation amount ratio.

5 Claims, 14 Drawing Sheets

IMAGE FORMING APPARATUS WITH DEVELOPER AMOUNT DETECTION

FIELD OF THE INVENTION AND RELATED ART

The present invention relates to an image forming apparatus such as a copying machine, a printer, and the like, which is provided with a function for forming an image on a recording medium such as a sheet of paper.

In the field of an electrophotographic image forming apparatus, that is, an image forming apparatus which employs an electrophotographic image formation process, it is a common practice to employ a process cartridge system, which integrally places a photosensitive drum, and means for processing the photosensitive drum, in a cartridge so that the photosensitive drum and processing means can be removably mountable in the main assembly of the image forming apparatus. The employment of a process cartridge makes it possible for a user of an electrophotographic image forming apparatus to maintain the image forming apparatus by himself or herself, that is, without relying on service personnel. Thus, it can substantially improve an electrophotographic image forming apparatus in operational efficiency. In order to improve the maintenance of an electrophotographic image forming apparatus based on a cartridge system, it is desired that a user is informed of the proper timing for cartridge replacement. In other words, it is necessary for the remaining length of the service life of a cartridge to be accurately detected.

There are various factors that can be used to determine the remaining length of the service life of a process cartridge. One of the factors is the remaining amount of developer in a process cartridge, which can be directly or indirectly detected by various methods. There have been proposed various methods for detecting the remaining amount of developer in a cartridge, for example, the pixel counting method, antenna-based method, optical method, patch detection method, and combination of the preceding methods (Japanese Laid-open Patent Application 2009-37225). Another factor usable to determine the remaining length of the service life of a process cartridge is the remaining length of the service life of a photosensitive drum in the cartridge. One of the proposed methods for determining the remaining length of service life of a photosensitive drum is to use a cumulative number of rotations of the photosensitive drum (Japanese Laid-open Patent Application H08-185094.

The optical method which detects the remaining amount of developer in a process cartridge uses an optical means which has a light passage in the developer storage portion of the cartridge. It determines the remaining amount of developer in the cartridge, based on the length of time the light emitted from the optical means is detected while the developer in the developer storage portion of the cartridge is stirred by the developer stirring means of the cartridge.

This optical method for detecting the remaining amount of developer in a process cartridge can detect the remaining amount of developer in the cartridge at a higher level of accuracy than the pixel counting method which estimates the remaining amount of the developer in a process cartridge, based on the cumulative amount of developer consumption, and the antenna-based method, the accuracy of which is affected by ambient humidity. However, the optical method has its own problem. That is, if the speed at which the developer in a cartridge is stirred is high, the developer is unstable in behavior, making it difficult to accurately detect the amount of developer in the cartridge. Thus, it has been proposed to switch the printing speed of an electrophotographic image forming apparatus from the normal speed to a preset slow speed before detecting the amount of remaining developer in the cartridge, in order to stabilize the developer in behavior (Japanese Laid-open Patent Application 2007-57732.

However, conventional image forming apparatuses such as those described above have the following problems. That is, if the rotational speed of the developer stirring means, which is suitable to accurately detect the amount of remaining developer in a process cartridge, is different from the normal speed at which the developing device driving means is driven during a printing operation, the developing means driving means has to be changed in speed before detecting the amount of remaining developer in the cartridge. Thus, the on-going printing operation has to be temporarily stopped before detecting the amount of remaining developer in the cartridge. In other words, downtime occurs.

Conventional image forming apparatuses are designed to detect each of the causes of why a process cartridge reaches the end of its life (for example, cartridge runs out of developer; photosensitive drum reaches end of its life; etc.). Thus, they detect the amount of residual developer in a process cartridge even if the residual life of the photosensitive drum in the cartridge is not long enough to outlast the residual developer in the cartridge, for example, in a case where a user outputs a large number of images which are relatively low in printing ratio, or intermittently carries out a substantial number of image forming operations which are relatively small in image output. Not only does an operation for detecting the amount of residual developer in a process cartridge in an electrophotographic image forming apparatus drive the means for stirring the developer, but also, the developing device of the image forming apparatus. In other words, the operation increases the length of time the developing device is driven. Further, the amount of deterioration of the developer in a developing device is related to the length of time the developing device is driven. Thus, there is a concern that a process cartridge is reduced in service life by the operation for detecting the amount of residual developer in the cartridge. It is also feared that if an electrophotographic image forming apparatus is structured so that the amount of residual developer in a process cartridge is detected while the photosensitive drum and developing device (development roller) of the apparatus are kept in contact with each other, the photosensitive drum is shaved by the developing device (development roller), which in turn shortens the service life of the cartridge. That is, detecting the amount of residual developer in the cartridge in an electrophotographic image forming apparatus creates two problems; it increases the apparatus in the amount of downtime, and shortens the cartridge in the apparatus in the length of its service life.

SUMMARY OF THE INVENTION

The present invention was made in consideration of the above-described issues. Thus, the primary object of the present invention is to minimize an electrophotographic image forming apparatus in the length of the downtime attributable to the operation for detecting the amount of residual toner in the process cartridge in the image forming apparatus, and also, in the length by which the cartridge in the image forming apparatus is reduced in the length of service life by the operation for detecting the amount of residual developer in the cartridge.

According to an aspect of the present invention, there is provided an image forming apparatus comprising a cartridge detachably mountable to a main assembly of the image forming apparatus, said cartridge including a developer accommodating portion for accommodating a developer, and an operation member; a remaining amount detector for detecting a remaining amount of the developer in said developer accommodating portion when an image forming operation is not carried out while said operation member is in operation; an operation amount detector for detecting a cumulative operation amount of said operation member, wherein an end of a service life of said cartridge is discriminated when said remaining amount detector detects that the remaining amount of the developer becomes less than a predetermined amount, and an end of the service life of said cartridge is discriminated when said operation amount detector detects an end of said operation member; and a setting device for setting, on the basis of a remaining amount of the developer detected by said remaining amount detector and the cumulative operation amount of said operation member detected by said operation amount detector, timing of subsequent remaining amount detection of said remaining amount detector.

According to the present invention, it is possible to minimize an electrophotographic image forming apparatus in the length of the downtime attributable to the operation for detecting of the amount of residual toner in the process cartridge in the image forming apparatus, and also, in the length by which the cartridge in the image forming apparatus is reduced in the length of service life by the operation for detecting the amount of residual developer in the cartridge.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the present invention is described in detail with reference to the preferred embodiments of the present invention. However, the measurements, materials, and shapes of the structural components of the image forming apparatuses in the preferred embodiments of the present invention, and the positional relationship among the components, are not intended to limit the present invention in scope. That is, they are to be altered as necessary according to the structure of an image forming apparatus to which the present invention is applied, and also, various conditions under which the apparatus is used.

Embodiment 1

Figure 1:
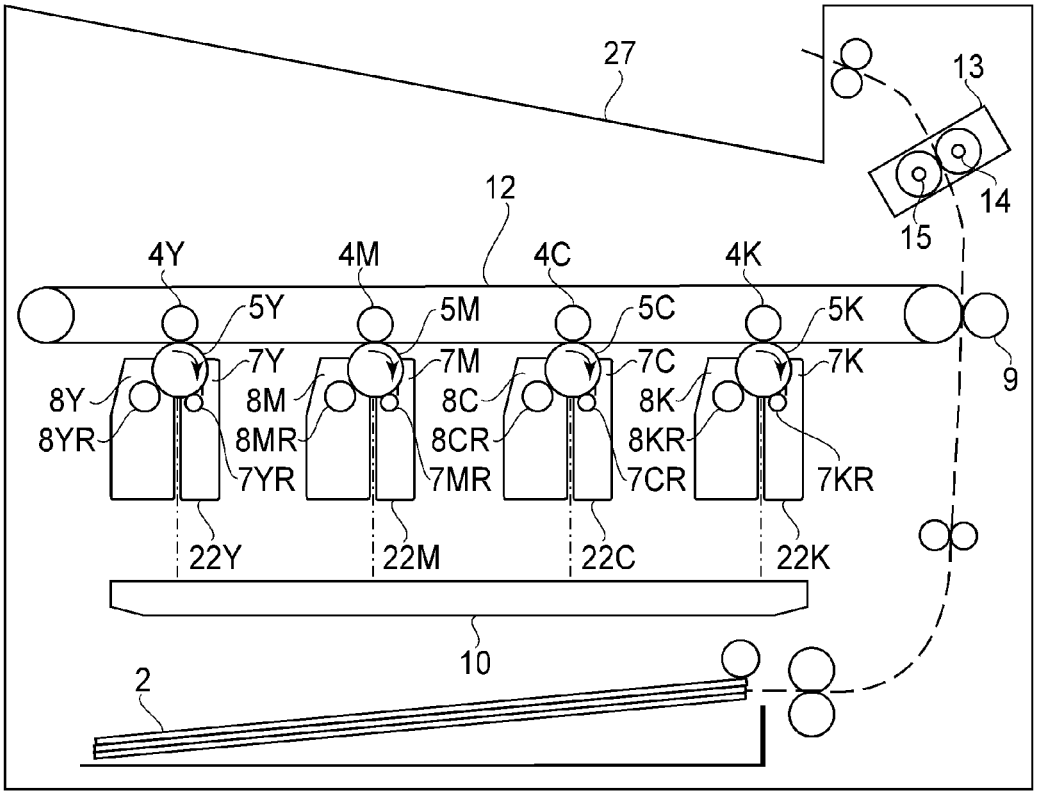
FIG. 1 is a schematic sectional view of the image forming apparatus in the first preferred embodiment of the present invention, and shows the general structure of the apparatus.
Figure 2:
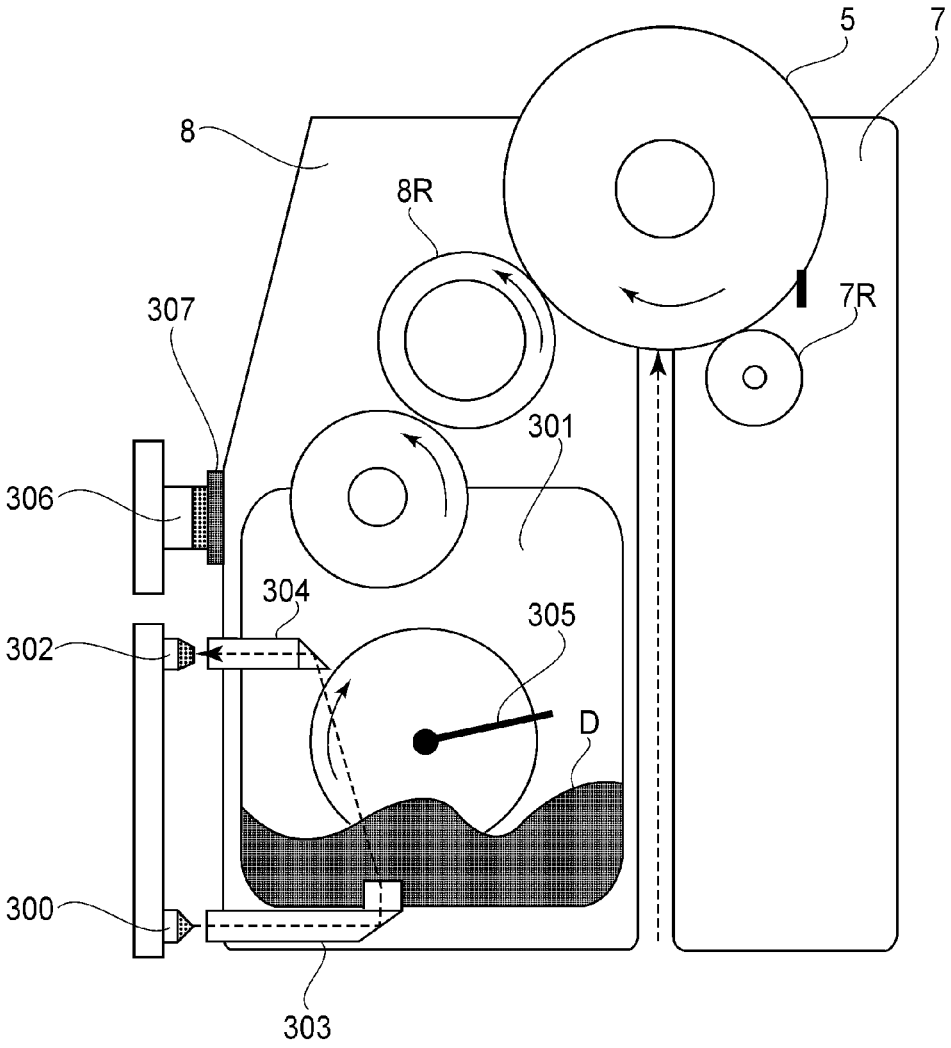
FIG. 2 is a drawing for describing the residual toner amount detecting method of the so-called light transmission type in the first preferred embodiment of the present invention.

Next, referring to FIGS. 1 and 2, the first preferred embodiment of the present invention is described. FIG. 1 is a sectional view of a laser printer as one of the examples of the image forming apparatus in accordance with the present invention. It shows the general structure of the printer.

The multicolor image forming operation of this laser printer is as follows. In each of the multiple image formation stations of the apparatus, an electrostatic latent image is formed in response to the beam of laser light emitted while being modulated with pixel signals sent from the control section of the image forming apparatus. The electrostatic latent image is developed into a visible image. Then, the multiple visible images, different in color, are transferred in layers onto the intermediary transferring means of the apparatus, effecting a full-color image on the intermediary transferring means. Then, the full-color image is transferred onto a sheet 2 of recording medium, and fixed to the sheet 2.

The image forming apparatus has multiple image formation stations, the number of which corresponds to the number of developers which the apparatus uses. The image formation stations are aligned in parallel in the direction in which a sheet 2 of recording medium is conveyed through the apparatus. Each image formation station is made up of a photosensitive drum 5 (5Y, 5M, 5C or 5K), a charging device 7 (7Y, 7M, 7C or 7K, as primary charging device), a developing device 8 (8Y, 8M, 8C or 8K), and an intermediary transferring member 12. The photosensitive drum 5, charging device 7, and developing device 8 are mounted in a cartridge 22 (22Y, 22M, 22C or 22K) which is removably (replaceably) mountable in the main assembly of the image forming apparatus.

The multiple cartridges are practically the same in structure and operation, although they are different in the color of the toner (developer) they use. Thus, they are going to be described together with reference to one of them, and the suffixes Y, M, C and K, which are for showing the color of the toner (developer) contained in each cartridge, are not going to be shown unless necessary. A cartridge 22 is equivalent to any of the image formation units of the image forming apparatus.

The photosensitive drum 5 is an image bearing member. It is made up of an aluminum cylinder, and an organic photoconductive layer formed on the peripheral surface of the aluminum cylinder by coating. It is rotated in the clockwise direction by driving force transmitted thereto from an unshown motor, in synchronism with the progression of an image forming operation. The beam of light for exposing the photosensitive drum 5 is sent from a scanner section 10 of the apparatus. The image forming apparatus is structured so that as the numerous points of the peripheral surface of the photosensitive drum 5 are exposed, an electrostatic latent image is effected on the peripheral surface of the photosensitive drum 5.

The image forming apparatus is provided with four charging devices 7, which are for charging the four photosensitive drums 5 in the four formation stations (Y), (M), (C) and (K), one for one. The four charging devices 7 are provided with primary charge rollers 7YR, 7MR, 7CR and 7KR, one for one.

Further, the image forming apparatus is provided with four developing devices 8, one for each image formation station. The developing devices 8 are for developing an electrostatic latent image into a visible image with the use of toner (developer). The four developing devices 8 are provided with development rollers 8YR, 8MR, 8CR and 8KR, one for one. Further, each developing device 8 is provided with a toner storage in which the toner D, which will be described later, is stored. Further, it is structured so that the residual toner amount in the toner storage can be detected.

The image forming apparatus is structured so that the intermediary transferring member 12 is in contact with all the photosensitive drum 5, and also so that as the photosensitive drums 5 are rotated for color image formation, the intermediary transferring member 12 is circularly moved in the counterclockwise direction (in FIG. 1) by the rotation of the photosensitive drums 5. As the primary transfer bias is applied to the primary transfer roller 4 in each image formation station, the visible image on the photosensitive drum 5 is transferred onto the intermediary transferring member 12 by the primary transfer bias, in the nip (primary transfer nip) between the photosensitive drum 5 and primary transfer roller 4. In other words, multiple (four) monochromatic color images, different in color, are sequentially transferred in layers onto the intermediary transferring member 12. Then, as the area of the intermediary transferring member 12, on which the visible image is present, is conveyed, along with a sheet 2 of recording medium, through the nip (secondary transfer nip) between the intermediary transferring member 12 and secondary transfer roller 9, the multiple monochromatic color images on the intermediary transferring member 12 are transferred together in layers onto the sheet 2.

The fixing station 13 is the station in which the transferred visible multicolor image on the sheet 2 of recording medium is fixed to the sheet 2 while the sheet 2 is conveyed through the station. The fixing station 13 is equipped with a fixation roller 14 for heating the sheet 2, and a pressure roller 15 for keeping the sheet 2 pressed upon the fixation roller 14. The fixation roller 14 and pressure roller 15 are hollow. Further, there is a heater in the hollow of the fixation roller 14.

More concretely, the sheet 2 on which the multicolor images are present is conveyed through the fixation nip which the fixation roller 14 and pressure roller 15 form. While the sheet 2 is conveyed through the fixation nip, heat and pressure applied to the sheet 2 and the multicolor image thereon. Thus, the toners of which the multicolor image is made up are fixed to one of the surfaces of the sheet 2. After the fixation of the visible image to the sheet 2, the sheet 2 is discharged into a delivery section 27 (tray), ending the image forming operation.

(Detection of Residual Toner Amount)

Next, referring to FIG. 2, the process for detecting the residual amount of toner (developer) in the process cartridge, by transmitting a beam of light through the toner (developer) storage of the process cartridge, in this embodiment, is described. FIG. 2 is a schematic sectional view of the process cartridge 22 in this embodiment, and shows the general structure of the cartridge 22.

Referring to FIG. 2, the developing device 8 of the cartridge 22 contains toner D. It has: a toner storage 301 (developer storage) in which the toner D is stored; and a toner stirring member 305 for stirring the toner D in the toner storage 301. The toner storage 301 is provided with a pair of light transmission windows 303 and 304, through which a beam of light is projected through the toner storage 301.

Also referring to FIG. 2, the image forming apparatus has a light emitting section 300 and a light receiving section 302. The light emitting section 300 is for emitting a beam of light to detect the residual amount of toner in the toner storage 301 (developer storage). The light receiving section 302 is for receiving the beam of light transmitted through the toner storage 301 from the light emitting section 300. In this embodiment, the light emitting section 300 is an LED, and the light receiving section 302 is a PTR (photo-transistor). The residual toner amount detecting method of the so-called light transmission type is such a residual toner amount detecting method that projects a beam of light though the toner storage 301 to detect the residual amount of toner in the toner storage 301.

The image forming apparatus is structured so that when there is no toner in the toner storage 301 (when residual amount of toner is no more than preset value), the beam of light from the light emitting section 300, which is made to enter the toner storage 301 through the light transmission window 303, passes through the toner storage 301, exits from the toner storage 301 through the light transmission window 304, and is guided to the light receiving section 302. Further, the image forming apparatus is structured so that when there is a sufficient amount of toner D in the toner storage 301, the beam of light from the light emitting section 300 is blocked by the toner D in the light beam passage between the light transmission windows 303 and 304, failing thereby from reaching the light receiving section 302.

Further, the image forming apparatus in this embodiment is structured so that during the process of detecting the residual amount of toner in the developing device 8, the CPU 205 (central processing unit, which will be described later in detail), drives the developing means driving motor 211 (which also will be described later in detail) with preset intervals to rotate the toner stirring member 305 with the preset intervals. That is, while the residual toner amount is detected, the toner stirring member 305 is rotated with the preset intervals, and therefore, the beam of light put through the toner storage 301 is intermittently blocked even if there is no toner D in the toner storage 301. Therefore, the period in which the light receiving section 302 receives the beam of light and the period in which the light receiving section 302 does not receive the beam of light alternate.

When a certain amount of toner D is remaining in the toner storage 301, the toner D is moved through the light beam passage by the toner stirring member 305. Therefore, when a certain amount of toner D is remaining in the toner storage 301, the length of time the beam of light remains blocked is longer than when there is no toner D in the toner storage 301. The length of time the residual toner amount detection beam of light remains blocked is related to the amount of toner in the toner storage 301.

Therefore, the amount of toner D in the toner storage 301 can be detected by obtaining the ratio of the length of time the beam of light remains blocked, relative to the frequency (which hereafter will be referred to as stirring frequency) with which the toner stirring member 305 is rotated. Incidentally, the amount of toner D in the toner storage 301 can be detected by comparing the ratio of the length of time the beam of light is received, relative to the length of time the beam of light is emitted, instead of comparing the ratio of the length of time the beam of light is blocked, relative to the length of time the beam of light is emitted.

Figure 3A:
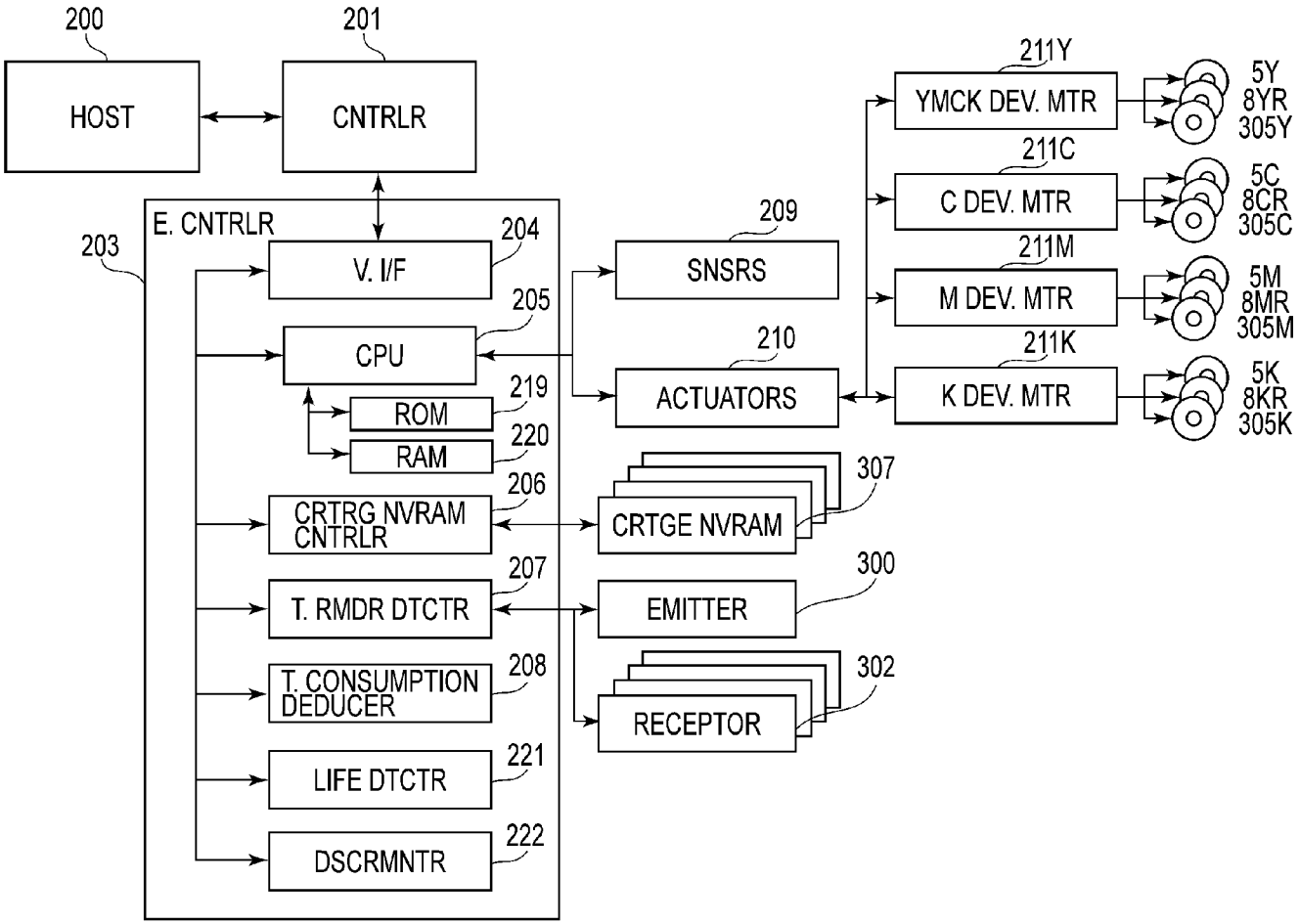
FIGS. 3A, 3B and 3C are block diagrams of the control system of the control section of the image forming apparatus in the first embodiment, and show the structure of the system.
Figure 3B:
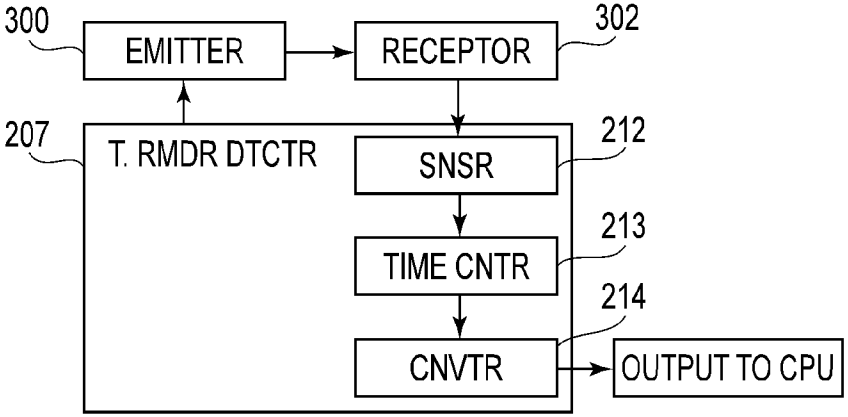

FIG. 3B is a block diagram of the residual toner amount detecting section 207 as the optical residual toner amount detecting device (residual toner amount deriving device) in this embodiment. It shows the general structure of the residual toner amount detecting system.

Referring to FIG. 3B, the residual toner amount detecting section 207 has a light reception detecting section 212, a light reception length counter 213, and a residual toner amount calculating section 214 (conversion section), in addition to the light emitting section 300 and light receiving section 302.

The output of the light receiving section 302 is inputted into the light reception detecting section 212, which sends an output signal (which hereafter will be referred to as light reception signal) to the light reception length counter 213 only when the light received by the light reception detecting section 212 is higher in signal level than a preset value. The light reception length counter 213 measures the length of time it receives the light reception signal, and sends the value of the measured length of time it received the light reception signal to the residual toner amount calculating section 214.

The residual toner amount calculating section 214 calculates the residual toner amount in the toner storage 301 (ratio A (%) of residual amount of toner in toner storage 301 relative to maximum amount of toner storable in toner storage 301), and sends the residual toner amount A (%), as the residual toner amount data, to the CPU 205. Here, the method for detecting the residual amount of toner in one of the cartridges in the image forming apparatus was described. In this embodiment, however, each image formation station is provided with the above described residual toner amount detecting section 207. Thus, each image formation station can calculate the remaining amount of toner in the toner storage 301 in the process cartridge therein, and send the amount of toner remaining in the toner storage 301 to the CPU 205, independently from the other image formation stations.

Further, in this embodiment, the speed at which the toner stirring member 305 is rotated with the preset frequency when the residual amount of toner in the toner storage 301 is detected is set to ⅓ the speed at which the developing means driving motor 211 is rotated during a printing operation (image forming operation), because the rotational speed of the toner stirring member 305 affects the accuracy with which the residual amount of toner in the toner storage 301 can be detected. More concretely, the rotational speed of the toner stirring member 305 affects how the toner D in the toner storage 301 mixes with the air in the toner storage 301 as the toner D is stirred by the toner stirring member 305, and also, the state of mixture between the toner D and air. That is, the rotational speed of the toner stirring member 305 affects the fluidity of the toner D in the toner storage 301. Generally speaking, the faster the rotational speed of the toner stirring member 305, the better the toner D mixes with air, becoming thereby higher in fluidity, whereas the slower the rotational speed of the toner stirring member 305, the less the toner D mixes with air, being therefore lower in fluidity.

When the toner D is high in fluidity, it quickly covers the light transmission window 303 as soon as the toner stirring member 305 wipes away the body of toner D on the surface of the light transmission window 303. Thus, there is little difference between the length of time the beam of light is detected by the light receiving section 302 when a substantial amount of toner is remaining in the toner storage 301 and the length of time the beam of light is detected by the light receiving section 303 when only a small amount of toner is remaining in the toner storage 301, making it impossible for the residual toner amount in the toner storage 301 to be accurately detected.

For the reason given above, it is necessary to stop (interrupt) the on-going printing operation, and reduce the speed at which the developing device driving motor 211 is rotated to drive the toner stirring member 305, to ⅓ the speed at which the motor 211 is rotated during the normal printing operation. Thus, downtime occurs.

Further, as described above, when the residual toner amount is detected, the developing device driving motor 211 is driven. Thus, in a case where the photosensitive drum 5 is in connection to the developing device driving motor 211, the photosensitive drum 5 is rotated while the residual toner amount is detected. Therefore, it is feared that the operation for detecting the residual amount of toner in the toner storage 301 leads to shortening of the service life of the cartridge 22.

(Structure of Control Section of Image Forming Apparatus)

Next, referring to the block diagram in FIG. 3A, the system structure of the entirety of the control section of the image forming apparatus in this embodiment is described.

Referring to FIG. 3A, designated by referential codes 200 and 201 are a host computer and a controller section 201, respectively. Designated by a referential code 203 is an engine control section, which has a video-interface 204, a CPU 205, a cartridge NVRAM control 206, the residual toner amount detecting section 207, a toner consumption amount estimating section 208, a residual photosensitive drum life detecting section 221, and the residual toner amount detection management section 222.

The controller section 201 receives image information and a print command from the host computer 200. It analyzes the received image information, and converts the information into bit data. Then, it transmits a print reservation command, a print start command, and video signals to the engine control section 203, per sheet of recording medium, through the video-interface section 204.

The CPU 205 of the engine control section 203 carries out or ends an image forming apparatus by sending power to various actuators 210, based on the information it obtained with the use of various sensors 209. The CPU 205 has a ROM in which program codes and program data are stored, and a RAM 220 in which the data are temporarily stored. Among the actuators 210, the developing device driving motor 211 in each of the image formation stations Y, M, C and K is in connection to the photosensitive drum 5, development roller 8R, and toner stirring member 305 in the image formation station. As the CPU 205 rotates the developing device driving motor 211 by outputting a signal, the photosensitive drum 5, development roller 8R, and toner stirring member 305 are provided with the force which drives them.

The toner consumption amount estimating section 208 receives the picture element signal sent from the controller section 201, and estimates the amount of toner consumption for each image formation station, based on the received picture element signals. The residual toner amount detecting section 207 determines the residual amount of toner in the toner storage 301 by operating the light emitting section 300 and light receiving section 302 shown in FIG. 2. The cartridge NVRAM control section 206 is in connection to the NVRAM reading/writing section 306 of the cartridge shown in FIG. 2. It can write information into the cartridge NVRAM 307, or can read information from the cartridge NVRAM 307.

The residual photosensitive drum life detecting section 221 receives from the CPU 205, the speed at which the photosensitive drum 5 is driven. Then, it converts the speed into the number of rotations of the photosensitive drum 5. Then, it determines the residual life of the photosensitive drum 5, based on the total number of rotations (cumulative number of rotation) of the photosensitive drum 5. Then, it deduces, as the residual life B of the photosensitive drum 5, the ratio of the total number of times the photosensitive drum 5 is going to be rotated from when the residual life of the photosensitive drum 5 is detected by the residual photosensitive drum life detecting section 221 to when the photosensitive drum 5 will reach the end of its life, relative to the total number of times the photosensitive drum 5 is going to be rotated from when the cartridge 22 is brand-new to when the photosensitive drum 5 reaches the end of its life. The deduced residual life B of the photosensitive drum 5 is stored in the cartridge NVRAM 307 by the cartridge NVRAM control section 206.

The image forming apparatus can be prevented from outputting a foggy image, by determining the residual life B of the cartridge based on the determination of the residual length of the life of the photosensitive drum 5. Here, the photosensitive drum 5 is one of the movable members of the cartridge. Further, the residual photosensitive drum life detecting section 221 is the means for deducing the amount by which the photosensitive drum 5 was made to operate from when the photosensitive drum 5 is brand-new.

Then, the detected amount of residual toner in the toner storage 301 described above is compared with the calculated amount of residual service life of the photosensitive drum 5. Then, the smaller of the two is used as the residual length of the service life of the cartridge. Therefore, it becomes possible to prevent the image forming apparatus from outputting an image which suffer from either unintended white spots or fog.

Further, in a case where the residual amount of toner in the cartridge 22 detected by the residual toner amount detection process becomes no more than a preset value and/or in a case where the photosensitive drum 5 reaches the end of its service life, it is determined that the cartridge 22 has reached the end of its service life.

In this embodiment, the residual toner amount detection management section 222 receives the residual life of the cartridge 22 (residual amount of toner and residual life of cartridge) through the CPU 205. Then, based on the received residual length of the life of the cartridge 22, it determines whether it is necessary to detect the residual amount of toner in the cartridge 22 (toner storage 301). If it determines that the detection is necessary, it detects the residual amount of toner in the cartridge 22. The residual toner amount detection management section 222 is equivalent to the means for detecting the residual toner amount. The process carried out by the residual toner amount detection management section 222 to determine whether it is necessary to detect the residual amount of toner in the cartridge 22 or not is described later.

(Toner Consumption Amount Estimating Section)

Next, the toner consumption amount estimating section 208 (calculating device) which estimates the amount by which toner (developer) is consumed during an image forming operation is described.

Generally speaking, the amount of toner consumption is proportional to the number of pixel signals (pixel count) as the pixel information of an image to be outputted, that is, the information of an image to be formed on a sheet P of recording medium by an image forming operation. Thus, the amount W of toner consumption is estimated with the use of the following mathematical equation:

$$W = PC \times W\text{dot} \quad (1).$$

The toner consumption amount W is expressed in the form of percentage relative to the total amount (100%) of toner in a brand-new process cartridge. A term "PC" represents the pixel counts, that is, the number of times the beam of light is turned on to expose the peripheral surface of the photosensitive drum 5, and its measurement unit is a pixel. A term "Wdot" represents the toner consumption amount per pixel, and its measurement unit is a %/pixel. Further, the value of the term "Wdot" is determined by the toner capacity of the cartridge 22.

Figure 3C:
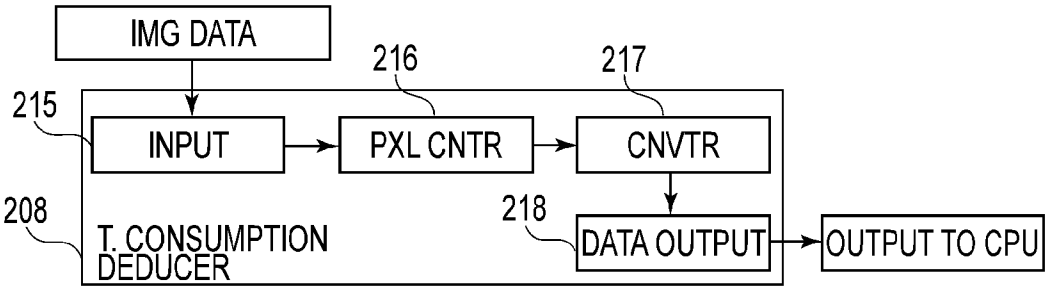

FIG. 3C is a block diagram of the toner consumption amount estimating section 208, as the residual developer amount estimating means, in this embodiment. It shows the structure of the section 208.

Referring to FIG. 3C, the toner consumption amount estimating section 208 has a pixel signal input section 215, a pixel signal counter 216, a toner consumption estimating section 217, and an estimated toner consumption amount outputting section 218.

The image data sent from the host computer 200 are expanded by the controller section 201, and then, are converted into pixel signals for the image to be outputted. Then, the pixel signals are inputted into the pixel signal input section 215 by way of the video-interface section 204 of the engine control section 203, and are converted in signal form from the analog form (low voltage/high voltage form) into the digital form (1/0 form) to make it easier for the pixel signal counter 216 to count.

The pixel signal counter 216 counts the total number of the pixel signals generated per page by the pixel signal inputting section 215, and outputs the value of the above-described PC per page. The outputted value of PC is sent to the toner consumption amount estimating section 217. Then, the toner consumption amount W is calculated with the use of Equation (1) given above. The calculated amount W of toner consumption is outputted to the CPU 205 by way of the toner consumption amount outputting section 218.

The CPU 205 consecutively obtains the estimated residual toner amount by subtracting the toner consumption amount W from the residual toner amount A obtained by the above described residual toner amount detecting section 207.

Further, the CPU 205 adds the toner consumption amount W which it received from the toner consumption amount data outputting section 218, to the cumulative toner consumption amount Wint stored in the RAM 220 of the CPU 205, obtaining thereby the current total amount of toner consumption in the cartridge 22 (current cumulative amount of toner consumption Wint).

Then, CPU 205 demands the cartridge NVRAM control section 206 to write the cumulative toner consumption amount Wint, and the cartridge NVRAM control section 206 stores the cumulative toner consumption amount Wint in the NVRAM 307 with which the cartridge 22 is provided.

This process is required because the cartridge 22 is removably mountable in the image forming apparatus. Thus, as the CPU 205 detects that the cartridge 22 in the image forming apparatus has just been replaced, it carries out the following operation. That is, the CPU 205 replaces the cumulative toner consumption amount Wint in the RAM 220 of the CPU 205, with the cumulative toner consumption amount Wint in the NVRAM 207 of the new cartridge, through the cartridge NVRAM control section 206.

Therefore, even if the cartridge in the printer is replaced with another cartridge, it becomes possible for the cumulative toner consumption amount Wint to be accurately obtained.

The CPU 205 can obtain the estimated amount of toner consumption at a given point in time, using the following method.

This method uses three criteria, that is, the last residual toner amount A obtained by the residual toner amount detecting section 207, a referential toner consumption amount Wb (cumulative toner consumption amount Wint stored when residual toner amount A was obtained), and cumulative toner consumption amount Wint at a given point in time. That is, the residual toner amount at a given point in time can be consecutively obtained with the use of the following equation:

$$\text{(Estimated residual toner amount)}-A-(W\text{int}-Wb).$$

(Residual Toner Amount Detection Timing Management Section)

Figure 4:
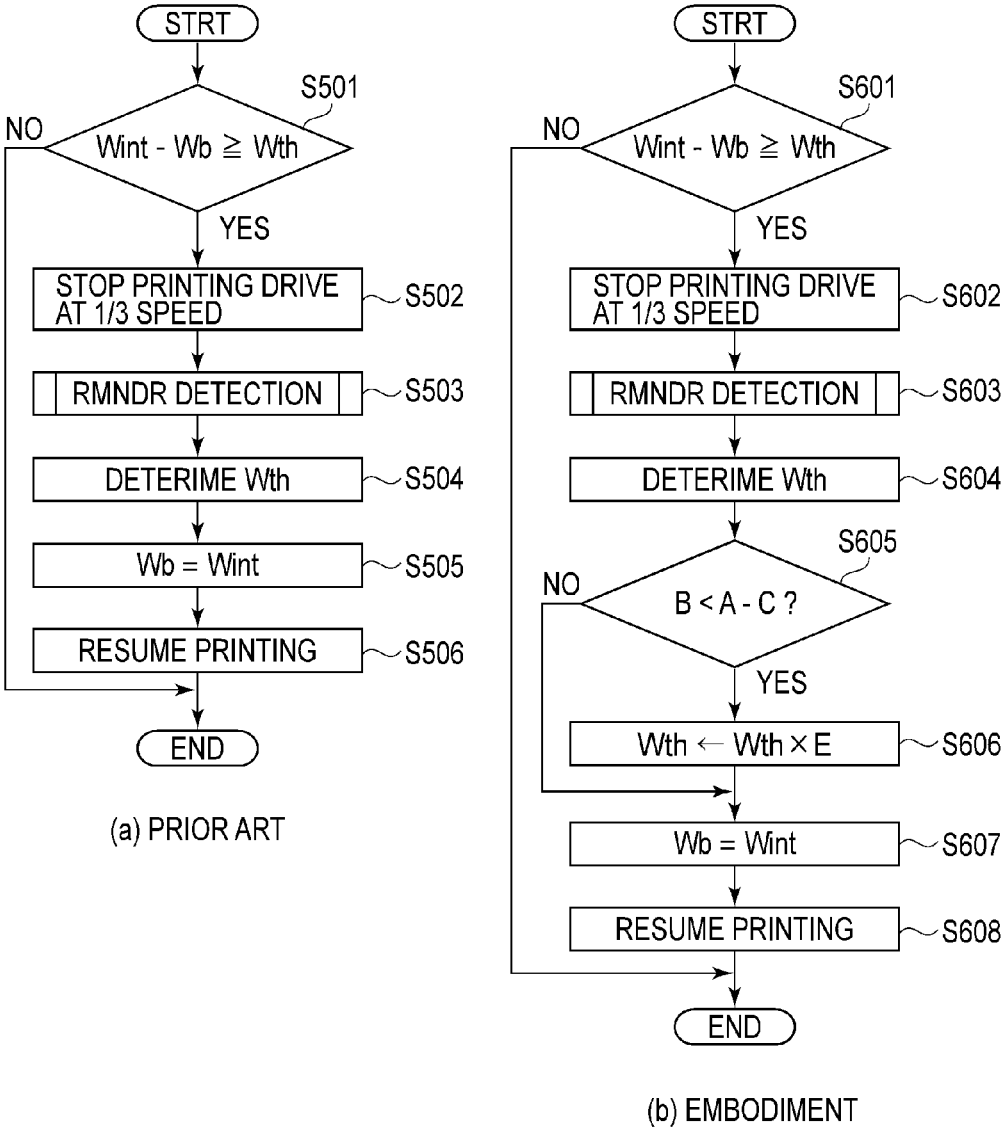
FIG. 4 is a drawing for describing the residual toner amount detection management process in the first embodiment.

Next, referring to FIG. 4(*a*), the process to be carried out, as the means for calculating the interval with which the residual developer amount is to be detected, by the residual toner amount detection management section 222 to calculate the interval with which the residual toner amount is to be detected, and the conventional process which uses the results of the residual toner amount detection interval calculation to determine whether or not the residual toner amount is to be carried out, are described.

FIG. 4(*a*) is a drawing which shows the conventional process carried out by the residual toner amount detection management section 222 to determine whether or not the residual toner amount is to be detected. In the following description of this subject, the process carried out by only one of the cartridges in the image forming apparatus to determine whether or not the residual toner amount is to be detected, is described in order to make the description simpler. However, in the case of an image forming apparatus, such as the one in this embodiment, which employs multiple process cartridges, the residual amount of toner in the cartridge is detected even if it is only one of the cartridges that needs to be detected in the residual amount of toner.

The CPU 205 makes the image forming apparatus carry out a printing operation, and each time the cumulative residual toner consumption amount Wint is renewed, it makes the residual toner amount detection management section 222 carry out the process, shown in FIG. 4(*a*), for determining whether or not the residual toner amount is to be detected.

The residual toner amount detection management section 222 compares the residual toner amount detection threshold value Wth, which was obtained when the residual toner amount was detected last time, with the difference between the referential toner consumption amount Wb (which is cumulative toner consumption amount at point in time when residual toner amount was detected last time) and current cumulative toner consumption amount Wint. If the difference between the referential toner consumption amount Wb and cumulative toner consumption amount Wint is no less than the threshold value Wth for determining whether or not the residual toner amount is to be detected, the CPU 205 determines that the residual toner amount is to be detected (S501). If the difference is no more than the threshold value Wth, the CPU 205 does not make the residual toner amount detection management section 222 detect the residual amount of toner in the cartridge, and ends the residual toner amount detection timing management process, that is, the process for determining whether or not the residual toner amount is to be detected (S501).

If the CPU 205 determines that the residual amount of toner needs to be detected, it interrupts the on-going printing operation to detect the residual toner amount. Then, it begins to drive the developing device driving motor 211 at the speed for detecting the residual toner amount (S502). As it begins to rotate the toner stirring member 305 by driving the developing device driving motor 211, it commands the residual toner amount detecting section 207 to detect the residual toner amount. The residual toner amount detecting section 207 calculates the residual toner amount A by carrying out the aforementioned process for detecting the residual toner amount, and sends the calculated residual toner amount A to the CPU 205 (S503).

As the residual toner amount detection management section 222 receives the residual toner amount A transmitted from the residual toner amount detecting section 207 by way of the CPU 205, it obtains the threshold value Wth for determining the residual toner amount detection interval (S504). Then, the residual toner amount detection management section 222 replaces the value of the referential toner consumption amount Wb with the value of the current cumulative toner consumption amount Wint (S505). Then, as soon as the process for detecting the residual amount of toner ends, the CPU 205 switches the speed of the developing device driving motor 211 from the one to which it was changed in S502, to its normal speed for an printing operation, ending thereby the residual toner amount detection timing management process, that is, the process for determining whether it is the time for detecting the residual toner amount (S506). Then, it restarts the interrupted printing operation.

Here, the threshold value Wth for determining whether or not it is the time for the residual toner amount detection is obtained by carrying out the process for calculating the interval for detecting the residual toner amount. In this embodiment, the threshold value Wth is determined by the residual toner amount detected by the residual toner amount detecting section 207 and the threshold value function Fth in mathematical formula (2):

$$Wth=Fth(A)=\text{Max}(3\%,0.25\times A) \quad (2).$$

The function $\text{Max}(p_1, p_2, \ldots p_n)$ is a function for obtaining the maximum value for parameters $p_i$ (i: 1-n).

Figure 5:
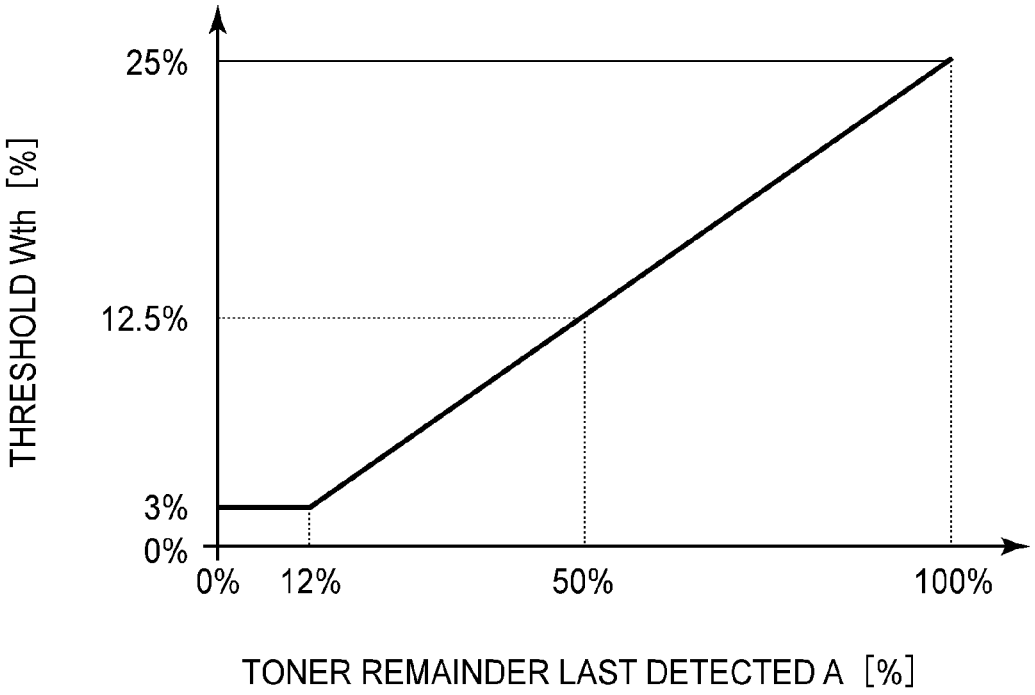
FIG. 5 is a graph which shows the relationship between the residual toner amount A and residual toner amount detection threshold value Wth in the first embodiment.

FIG. 5 shows the relationship between the residual toner amount A and the residual toner amount detection interval threshold Wth, that is, the value for determining whether or not it is the time for detecting the residual toner amount A.

Referring to FIG. 5, the threshold value Wth for determining whether or not it is the time for the residual toner amount detection is set so that the greater the residual toner amount, the longer the residual toner amount detection interval, and the smaller the residual toner amount, the shorter the residual toner amount detection interval, for the following reason. That is, when the residual toner amount is large, it is unnecessary to very accurately detect the residual toner amount, whereas when the residual toner amount is small, it is necessary to accurately detect the residual toner amount to accurately grasp the timing with which the cartridge runs out of toner, so that a user can be informed of the accurate timing with which the cartridge runs out of toner.

The reason why 3% is set as the smallest value for the threshold value Wth for setting the residual toner amount detection interval is for preventing the problem that toward the end of the service life of the cartridge, the residual toner amount is frequently detected, which results in the increase in downtime.

Figure 6:
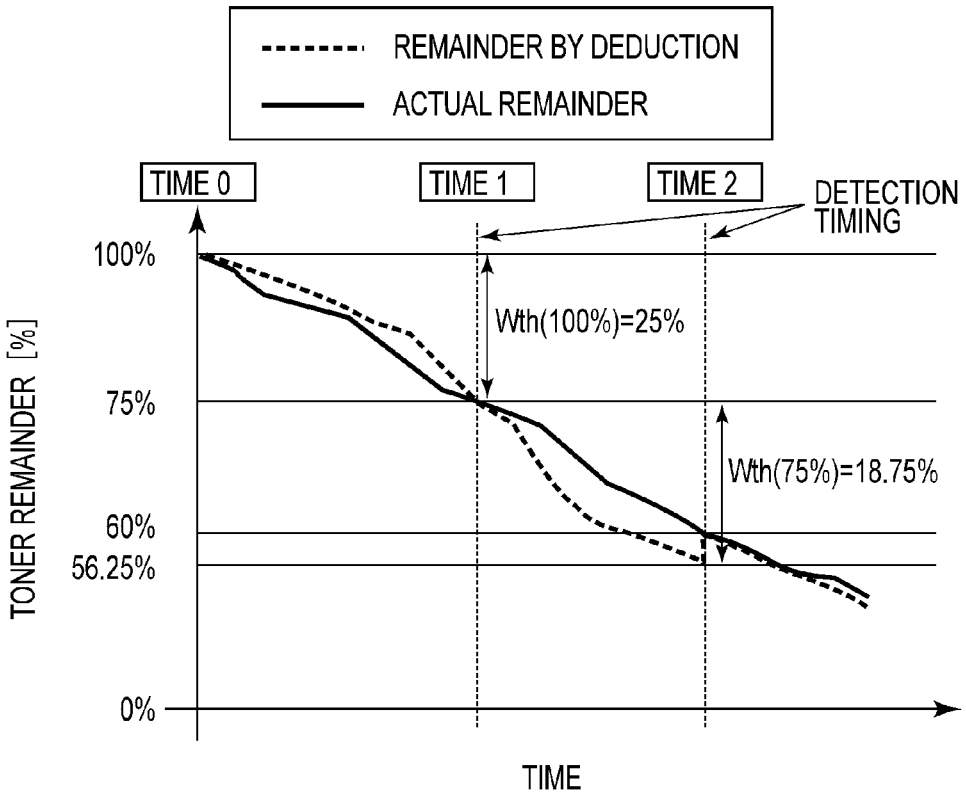
FIG. 6 is a drawing for describing the process through which the residual toner amount is detected in the first embodiment.

Next, referring to FIG. 6, how the residual toner amount in one of the cartridges is detected through the above described residual toner amount detection management process is described. In FIG. 6, a broken line represents the residual toner amount estimated by the toner consumption amount estimating section 208, and a solid line represents the actual amount (detected amount) of the residual toner in the toner storage 301.

It is assumed that at Point 0 in time FIG. 6, that is, when the cartridge is in the initial condition, the residual toner amount in the cartridge is 100%. That is, at Point 0 in time, the residual toner amount A is 100%, and the threshold value Wth for the interval for the residual toner amount detection is 0.25×100=25%. Further, the referential toner consumption amount Wb is 0%, and the cumulative toner consumption amount Wint is 0%.

With the elapse of time, the CPU 205 repeatedly makes the image forming apparatus form an image. Each time the image forming apparatus forms an image, the CPU 205 receives the toner consumption amount W outputted from the toner consumption amount estimating section 208. As it receives the toner consumption amount W, it estimates the residual amount of toner (broken line) by subtracting the toner consumption amount W from the current residual toner amount A. The toner consumption amount W is an estimated amount. Therefore, there is a small amount of discrepancy between the estimated residual amount of toner and actual residual amount of toner (solid line).

At Point 1 in time, the CPU 205 carries out the residual toner amount detection management process, that is, the process for determining whether or not it is the time to detect the residual toner amount, and determines whether or not the difference between the referential toner consumption amount Wb (=0%) and cumulative toner consumption amount Wint (−25%) is no less than the threshold value Wth (=25%) for determining whether or not it is the time to detect the residual toner amount. If it is no less than the threshold value Wth, the CPU 205 detects the residual toner amount by carrying out the residual toner amount detection management process, and obtains the actual residual toner amount A (=75%) from the residual toner amount detecting section 207.

Then, the CPU 205 carries out the residual toner amount detection management process and determines that the threshold value Wth for determining whether or not it is the time for detecting the residual toner amount is Fth (75%) =18.75%. Then, it replaces the value of the referential toner consumption amount Wb with the value (25%) of the current cumulative toner consumption amount Wint. From this point in time on, the CPU 205 repeats this process, and detects the residual amount of toner, obtaining thereby the actual residual toner amount A (−60%), at a point in time when the value of (residual toner amount A estimated at point 2 in time−(Wint−Wb)) reaches 56.25% (cumulative toner consumption amount Wint is 43.75%).

As described above, by carrying out the process, in this embodiment, for calculating the interval with which the residual toner amount is to be detected, and the process, in this embodiment, for determining whether or not it is the time for detecting the residual toner amount, it is possible to detect the residual toner amount before the difference between the estimated residual toner amount and actual residual toner amount becomes substantial. Therefore, it is possible to highly precisely obtain the residual amount of toner.

Next, referring to FIG. 4(*b*), the residual toner amount detection management process, which is one of the characteristic features of this embodiment and is carried out by the residual toner amount detection management section 222, is described. The residual toner amount detection interval calculating process in this embodiment is similar to the above-described conventional one, and therefore, is not going to be described here.

Each time the value of the cumulative toner consumption amount Wint is renewed after the completion of each image, the CPU 205 makes the residual toner amount detection management section 222 carry out the residual toner amount detection management process.

The residual toner amount detection management section 222 compares the value of the residual toner amount detection interval threshold Wth obtained when the residual toner amount was detected last time, with the difference between the referential toner consumption amount Wb (which is cumulative toner consumption amount when residual toner amount was detected last time) and the current cumulative toner consumption amount Wint. If the difference between the referential toner consumption amount Wb and the cumulative toner consumption amount Wint has become no less than the value the residual toner amount detection interval threshold Wth, the CPU 205 determines that the residual toner amount needs to be detected (S601). If the difference is no more than the threshold value Wth, the CPU 205 does not detect the residual toner amount, and ends the residual toner amount detection management process (S601). Here, the timing with which the difference between the referential toner consumption amount Wb and cumulative toner consumption amount Wint becomes no less than the value of the residual toner amount detection interval threshold Wth is equivalent to the preset timing.

If the CPU 205 determines that the residual toner amount needs to be detected, it interrupts the on-going printing operation to detect the residual amount of toner, and begins to drive the developing device driving motor 211 at the speed for detecting the residual toner amount (S602). As it begins to rotate the toner stirring member 305 by driving the developing device driving motor 211, it commands the residual toner amount detecting section 207 to detect the residual toner amount. The residual toner amount detecting section 207 calculates the residual toner amount A by carrying out the above described residual toner amount detecting process, and sends the calculated residual toner amount A to the CPU 205 (S603).

As the residual toner amount detection management section 222 receives the residual toner amount A from the residual toner amount detecting section 207 by way of the CPU 205, it obtains the value of the residual toner amount detection interval threshold Wth with the use of Formula (2) (S604). Then, it determines whether or not an inequality: (residual life B of photosensitive drum)<(residual toner amount A−residual toner amount detection extension margin C) is satisfied (S605).

Figure 7:
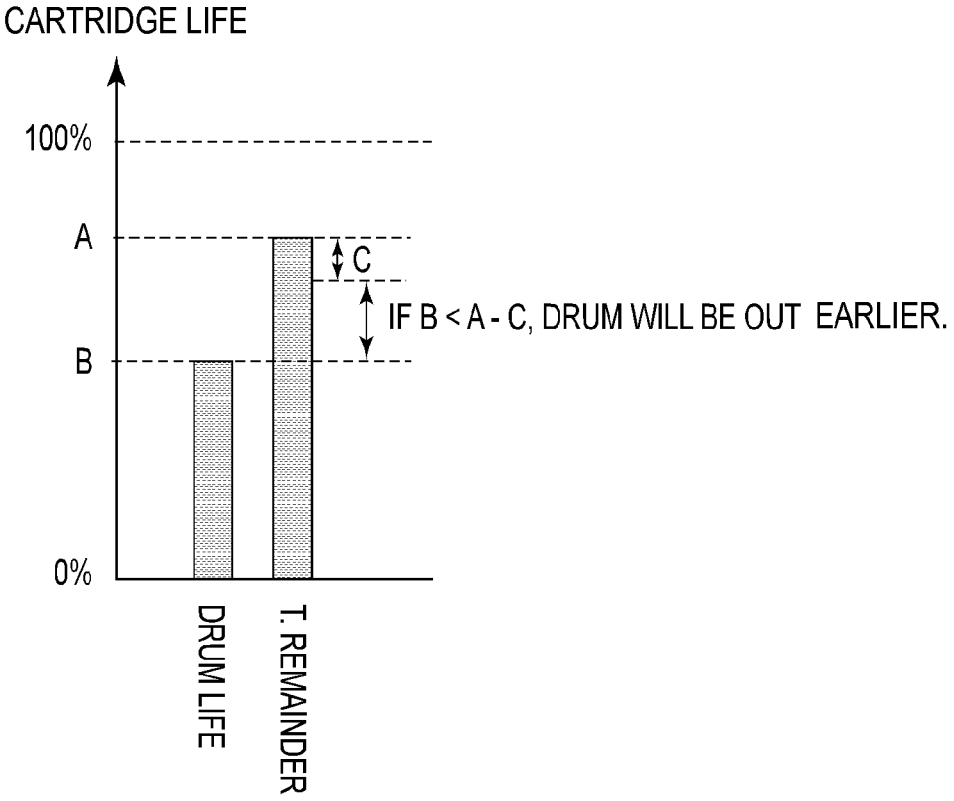
FIG. 7 is a drawing for describing the length of the service life of the process cartridge in the first embodiment.

The residual toner amount detection interval extension margin C is a value preset in the ROM 219 in the CPU 205 based on a level of the residual toner amount detection accuracy. It is 5%, for example. In S605, it determines whether the residual toner amount A is large enough for the residual toner in the cartridge 22 to outlast the photosensitive drum in the cartridge 22, as shown in FIG. 7, which is a drawing for describing the remaining length of the life of the cartridge 22.

If the inequality: (residual life B of photosensitive drum)< (residual toner amount A−residual toner amount detection interval extension margin C) is satisfied, that is, if it is determined that the residual toner amount is large enough for the residual toner in the cartridge 22 to outlast the photosensitive drum in the cartridge 22, the residual toner amount detection management section 222 (timing setting means) arranges the following setting.

That is, the residual toner amount detection management section 222 replaces the value of the residual toner amount detection interval threshold Wth, with the value obtained by multiplying the threshold Wth by a residual toner amount detection interval extension coefficient E (S606), so that the timing with which the residual toner amount is detected next time will be later than the preset one.

The residual toner amount detection interval extension coefficient E is a value preset in the ROM 219 in the CPU 205, based on the residual toner amount prediction accuracy. It is 1.5, for example.

The residual toner amount detection management section 222 replaces the value of the referential toner consumption amount Wb with the value of the current cumulative toner consumption amount Wint (S607). As the CPU 205 completes the process for detecting the residual toner amount, it restores the driving speed of the developing device driving motor 211 from the one to which the speed was switched in S602, to the normal speed for a printing operation. Then, it restarts the interrupted printing operation, ending thereby the residual toner amount detection management process, that is, the process for determining whether or not it is the time for the residual toner amount detection (S608).

In this embodiment, if the residual toner amount A in the cartridge 22 is very large in comparison to the residual life B of the photosensitive drum in the cartridge 22, that is, if the residual toner amount A is large enough for the residual toner to outlast the photosensitive drum, the timing with which the residual toner amount is detected is delayed. The reason for the delay is as follows.

Referring to FIG. 7, in a case where the residual toner amount A is large enough to outlast the residual life B of photosensitive drum, it is possible for the cartridge 22 to reach the end of its life because the photosensitive drum runs of its life before the cartridge 22 runs out of toner. That is, when the residual amount of toner in the cartridge 22 is large enough for the residual toner in the cartridge 22 to outlast the photosensitive drum in the cartridge 22, it is unlikely for the image forming apparatus to output an image which suffers from unwanted white spots attributable to the problem that the residual amount of toner in the cartridge 22 is too small. Therefore, it is reasonable to determine that it is unnecessary to highly precisely detect the residual toner amount. Thus, the CPU 205 delays the timing with which the residual toner amount is to be detected by the transmission of a beam of light through the toner storage 301 of the cartridge 22. The situation in which the residual amount of toner in the cartridge 22 is large enough to outlast the photosensitive drum in the cartridge 22 as shown in FIG. 7 occurs in the case where a user prints a large number of images which are low in printing ratio, and/or a user noncontinuously carries out a substantial number of image forming operations which are low in print count.

In this embodiment, the timing with which the residual toner amount is to be detected is delayed by multiplying the value of residual toner amount detection interval threshold Wth by a preset value. However, a method other than the one in this embodiment may be used to change the residual toner amount detection interval threshold Wth. For example, a preset value may be added to the threshold Wth.

(Example of Operational Sequence of Residual Toner Amount Detection Management Process)

Figure 8:
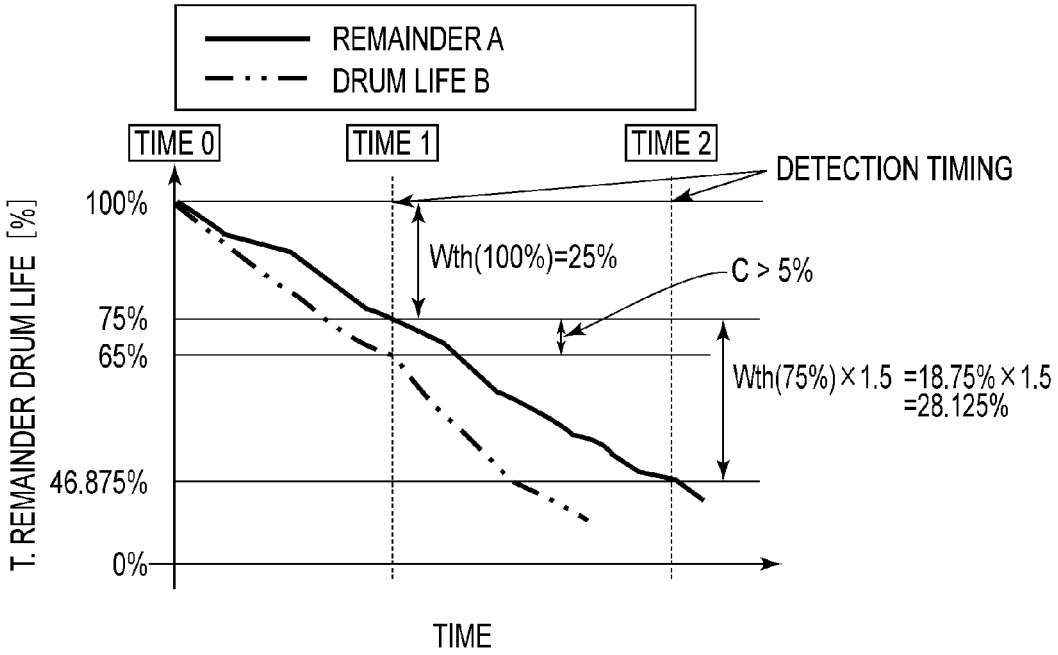
FIG. 8 is a drawing for describing the timing with which the residual toner amount is detected in the first embodiment.

Next, referring to FIG. 8, how and why the interval with which the residual toner amount is detected is extended by the above described residual toner amount detection management process is described.

FIG. 8 is a drawing which shows the changes in the residual toner amount, changes in the residual life of the photosensitive drum, and timing with which the residual toner amount is detected. For the sake of the simplification of the description of the process, it is assumed that there is no difference between the residual toner amount estimated from the output of the toner consumption amount estimating section 208, and the actual residual toner amount, in FIG. 8. That is, it is assumed that the estimated residual toner amount is equal to the actual residual toner amount.

Referring to FIG. 8, it is assumed that at Point 0 in time, the cartridge is brand-new; (estimated residual toner amount)=(actual residual toner amount)=100%. At this point in time, the residual toner amount A is 100%, and the value of the residual toner amount detection interval threshold Wth is 25% (=0.25×100). Further, the referential toner consumption amount Wb is 0%, and the cumulative toner consumption amount Wint is 0%. With the elapse of time, the number of images which the CPU 205 makes the image forming apparatus form increases. Each time an image is outputted, the CPU 205 receives the toner consumption amount W outputted from the toner consumption amount estimating section 208, and estimates the residual amount of toner.

At Point 1 in time FIG. 8, the CPU 205 carries out the residual toner amount detection management process; it determines whether or not the difference between the referential toner consumption amount Wb (=0%) and cumulative toner consumption amount Wint (=25%) is no less than the value of the residual toner amount detection interval threshold Wth. If it is no less than the threshold value Wth, the CPU 205 detects the residual amount of toner, based on the result of the process carried out by the residual toner amount detection management section 222 to determine whether or not it is the time for the residual toner amount detection; it obtains the actual residual toner amount A (=75%) from the residual toner amount detecting section 207.

Then, the CPU 205 determines that the value of the residual toner amount detection interval threshold Wth is Fth (75%)=18.75%. At Point 1 in time, the residual toner amount A is 75%, and the residual life B of the photosensitive drum is 65%. Since the residual toner amount detection interval extension margin C is 5%, the inequality: (residual life B of photosensitive drum)<(residual toner amount A−residual toner amount detection extension margin C) is satisfied. Thus, the CPU 205 replaces the value of the residual toner amount detection interval threshold Wth, with the value (18.75×1.5=28.125%) obtained by multiplying the value of the residual toner amount detection interval threshold Wth by the residual toner amount detection interval extension coefficient E (=1.5). The value of the referential toner consumption amount Wb is replaced with the value (25%) of the current cumulative toner consumption amount Wint.

From this point in time on, the CPU 205 repeats this process, and as the value of (residual toner amount A estimated at point 2 in time−(Wint−Wb)) reaches 46.875% (cumulative toner consumption amount Wint is 53.125%), the CPU 205 detects the residual toner amount. That is, in the case of the method in this embodiment shown in FIG. 8, the residual toner amount detection interval between Point 1 in time and Point 2 in time is 28.125%, which is substantially longer than 18.75% in the conventional method shown in FIG. 6.

As described above, in this embodiment, the timing with which the residual toner amount is to be detected is adjusted according to the relationship between the residual life of the photosensitive drum and the residual toner amount in the cartridge 22. With this practice, it is possible to reduce the overall number of times the residual toner amount is detected in the image forming apparatus (overall number of times residual toner amount is detected before cartridge 22 reaches end of its life), and also, it is only when it is absolutely necessary that the residual toner amount is detected. That is, the residual toner amount is detected with such interval that makes it possible to predict the timing of the expiration of the life of the cartridge 22 at a satisfactory level of accuracy.

As described above, in this embodiment, if the CPU 205 determines that it is not because the cartridge 22 runs out toner that the cartridge 22 reaches the end of its life, the CPU 205 extends the interval with which the residual toner amount is detected. With this practice, it is possible to reduce the number of times the residual toner amount is detected, and therefore, it is possible to prevent the problem that the image forming apparatus is increased in the amount of downtime by the detection of the residual amount of toner, and also, the problem that because the residual amount of toner is detected more times than absolutely necessary, the cartridge is unnecessarily reduced in the length of its service life.

Incidentally, the method used by the residual toner amount detecting section 207 does not need to be limited to the above described one, that is, the optical one. For example, it may be of the so-called patch detection type, or the like, which forms a referential toner image on the peripheral surface of the photosensitive drum by developing a referential latent image formed on the peripheral surface of the photosensitive drum, and determines the residual toner amount based on the reflection density of the referential toner image detected by an image density detecting means. That is, as long as a given method for detecting the residual amount of toner is such a method that affects the length of the downtime of the image forming apparatus and the residual life of the cartridge, it can be employed by the residual toner amount detecting section 207.

Further, the method employed by the residual toner amount estimating means to estimate the residual amount of toner does not need to be limited to the above described method, that is, a method which counts pixels. All that is necessary for a given method for estimating the residual toner amount to be employable by the residual toner amount estimating means is that it is capable of estimating the residual toner amount. For example, it may be such a method that estimates the residual toner amount based on the number of the sheets of recording medium on which an image was formed or cumulative area of sheets of recording medium on which an image was formed.

Further, the method employed by the residual photosensitive drum life detecting means in this embodiment counts the total number of rotations of the photosensitive drum 5. However, the residual photosensitive drum life detecting method to be employed by the residual photosensitive drum life detecting means does not need to be limited to the one in this embodiment. That is, any method may be employed as long as it can detect the residual photosensitive drum life.

Further, this embodiment was described with reference to a case where one of the main factors other than the residual toner amount in the cartridge 22, which affects the life of the cartridge 22, is the life of the photosensitive drum 5 in the cartridge 22. However, what causes the cartridge 22 to reach the end of its life is not limited to the amount of the toner in the cartridge 22 and the life of the photosensitive drum 5. For example, it may be the life of the cleaning mechanism which recovers the residual toner on the peripheral surface of the photosensitive drum 5, or the like. The life of at least one of the cartridge members which move during an image forming operation may be used as the other factor than the residual amount of toner in the cartridge 22, which affects the length of the life of the cartridge 22.

Embodiment 2

Next, the second preferred embodiment of the present invention is described. What is going to be primarily described here are the structural components of the image forming apparatus in this embodiment, which are different from the counterparts in the first embodiment. That is, the structural components of the image forming apparatus in this embodiment, which are similar to the counterparts in the first embodiment are not going to be described.

(Residual Toner Amount Detection Management Section)

Figure 9:
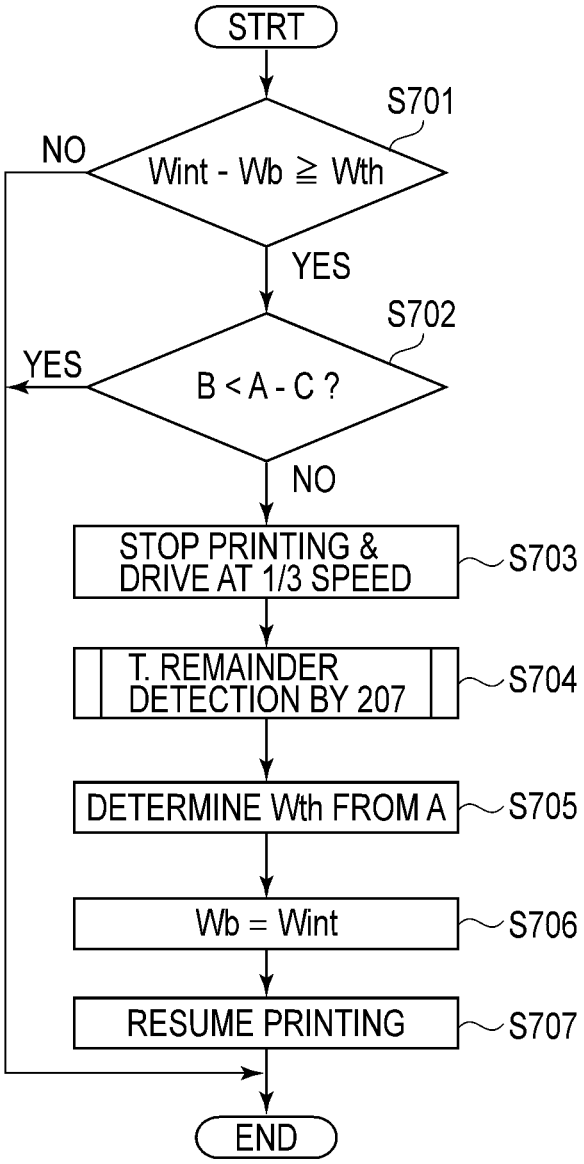
FIG. 9 is a drawing for describing the residual toner amount detection management process in the second preferred embodiment of the present invention.

FIG. 9 is a drawing for describing the residual toner amount detection management process, which is one of the characteristic features of this embodiment and is to be carried out by the residual toner amount detection management section 222. In the following description of this subject, the process carried out for only one of the cartridges to determine whether or not the residual toner amount is to be detected, is described in order to make the description simpler.

The CPU 205 makes the image forming apparatus carry out a printing operation, and each time the cumulative residual toner consumption amount Wint is renewed, it makes the residual toner amount detection management section 222 carry out the residual toner amount detection management process, shown in FIG. 9, that is, the process for determining whether or not it is the time for detecting the residual toner amount.

The residual toner amount detection management section 222 compares the value of the residual toner amount detection interval threshold Wth, which was obtained when the residual toner amount was detected last time, with the difference between the referential toner consumption amount Wb (which is cumulative toner consumption amount at point in time when residual toner amount was detected last time) and current cumulative toner consumption amount Wint. Then, it determines whether or not the difference between the referential toner consumption amount Wb and cumulative toner consumption amount Wint is no less than the value the residual toner amount detection interval threshold Wth (S701). If the difference between the referential toner consumption amount Wb and cumulative toner consumption amount Wint is no more than the value of the threshold Wth, the CPU 205 does not detect the residual amount of toner in the cartridge, and ends the residual toner amount detection management process (S701).

If the above-described value is no less than the value of the residual toner amount detection interval threshold Wth, the residual toner amount detection management section 222 determines whether or not the inequality: (residual life B of photosensitive drum)<(residual toner amount A−residual toner amount detection interval extension margin C) is satisfied (S702).

The residual toner amount detection interval extension margin C is a value preset in the ROM 219 in the CPU 205 based on a level of the residual toner amount detection accuracy. It is 5%, for example. In S702, it is determined whether the residual toner amount A is large enough for the residual toner in the cartridge 22 to outlast the residual life of the photosensitive drum in the cartridge 22, as shown in FIG. 7, which is a drawing for describing the residual life B of the cartridge 22.

If the inequality: (residual life B of photosensitive drum)< (residual toner amount A−residual toner amount detection interval extension margin C) is satisfied in S702, that is, if the CPU 205 determines that the residual toner amount A is large enough for the residual toner in the cartridge 22 to outlast the residual life of the photosensitive drum in the cartridge 22, it does not detect the residual toner amount, and ends the residual toner amount detection management process. If the inequality: (residual life B of photosensitive drum)<(residual toner amount A−residual toner amount detection interval extension margin C) is not satisfied, the residual toner amount detection management section 222 determines that the residual toner amount needs to be detected.

As the CPU 205 determines that the residual toner amount needs to be detected, it interrupts the on-going printing operation to detect the residual amount of toner, and begins to drive the developing device driving motor 211 at the speed for detecting the residual toner amount (S703). As it begins to rotate the toner stirring member 305 by driving the developing device driving motor 211, it commands the residual toner amount detecting section 207 to detect the residual toner amount.

The residual toner amount detecting section 207 calculates the residual toner amount A by carrying out the above described residual toner amount detecting process, and sends the calculated residual toner amount A to the CPU 205 (S704).

As the residual toner amount detection management section 222 receives the residual toner amount A from the residual toner amount detecting section 207 by way of the CPU 205, it obtains the value of the residual toner amount detection interval threshold Wth with the use of Formula (2) (S705). Then, it replaces the value of the referential toner consumption amount Wb with the value of the current cumulative toner consumption amount Wint (S706).

As the CPU 205 completes the process for detecting the residual toner amount, it restores the driving speed of the developing device driving motor 211 from the one to which the speed was switched in S703, to the normal speed for a printing operation. Then, it restarts the interrupted printing operation, ending thereby the residual toner amount detection management process (S707).

In this embodiment, if the residual toner amount A is very large in comparison to the residual life B of the photosensitive drum, that is, if the residual toner amount A is large enough for the residual toner in the cartridge 22 to outlast the residual life B of the photosensitive drum in the cartridge 22, the timing with which the residual toner amount is detected is delayed. The reason for the delay is as follows.

Referring to FIG. 7, in a case where the residual toner amount A is large enough for the residual toner to outlast the residual life B of the photosensitive drum, it is possible for the cartridge 22 to reach the end of its life because the photosensitive drum reaches the end of its life before the cartridge 22 runs out of toner. That is, when the residual amount of toner in the cartridge 22 is large enough for the residual toner in the cartridge 22 to outlast the photosensitive drum in the cartridge 22, it is unlikely for the image forming apparatus to output an image which suffers from unwanted white spots attributable to the problem that the residual amount of toner in the cartridge 22 is too small. Therefore, it is reasonable to determine that it is unnecessary to highly precisely detect the residual toner amount. Thus, the CPU 205 does not optically detect the residual amount of toner in the cartridge 22.

(Example of Operational Sequence of Residual Toner Amount Detection Management Process)

Figure 10:
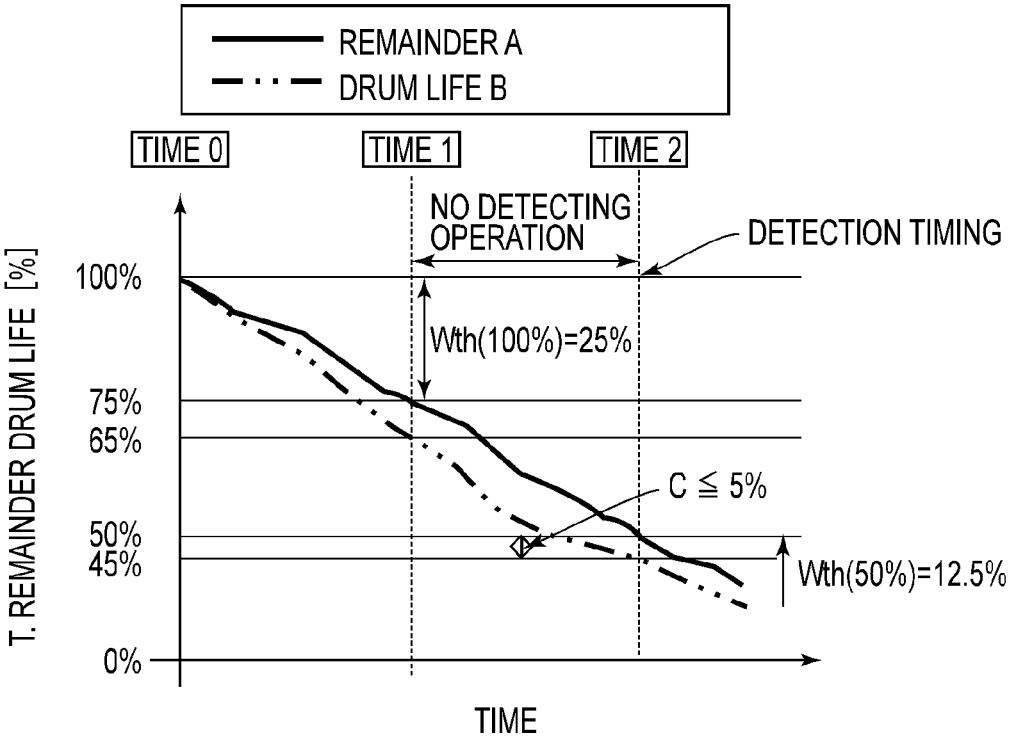
FIG. 10 is a drawing for describing the timing with which the residual toner amount is detected in the second embodiment.

Next, referring to FIG. 10, how the interval with which the residual toner amount is detected is extended by the above described residual toner amount detection management process is described.

FIG. 10 is a drawing which shows the changes in the residual toner amount, changes in the residual life of the photosensitive drum, and timing with which the residual toner amount is detected. For the sake of the simplification of the description of the process, it is assumed that there is no difference between the residual toner amount estimated from the output of the toner consumption amount estimating section 208, and the actual residual toner amount, in FIG. 10. That is, it is assumed that the estimated residual toner amount is equal to the actual residual toner amount.

Referring to FIG. 10, it is assumed that at Point 0 in time, the cartridge is brand-new; (estimated residual toner amount)=(actual residual toner amount)=100%. At this point in time, the residual toner amount A is 100%, and the value of the residual toner amount detection interval threshold Wth is 25% (=0.25×100). Further, the referential toner consumption amount Wb is 0%, and the cumulative toner consumption amount Wint is 0%.

With the elapse of time, the number of images which the CPU 205 makes the image forming apparatus form increases. Each time an image is outputted, the CPU 205 receives the toner consumption amount W outputted from the toner consumption amount estimating section 208, and estimates the residual amount of toner.

At Point 1 in time, the CPU 205 carries out the residual toner amount detection management process; it determines whether or not the difference between the referential toner consumption amount Wb (=0%) and cumulative toner consumption amount Wint (=25%) is no less than the value of the residual toner amount detection interval threshold Wth (=25%).

At Point 1 in time, however, the residual toner amount is 75%, and the residual life B of the photosensitive drum is 65%. Further, the residual toner amount detection interval extension margin C has been set to 5%. Therefore, the inequality: (residual life B of photosensitive drum)<(residual toner amount A−residual toner amount detection interval extension margin C) is satisfied in S702. Thus, the residual toner amount detection management section 222 determines that the residual toner amount does not need to be detected at this point in time.

Between the period from Point 1 in time to Point 2 in time, the inequality: (residual life B of photosensitive drum)<(residual toner amount A−residual toner amount detection interval extension margin C) remains satisfied. Therefore, the CPU 205 does not detect the residual toner amount. At Point 2 in time, the residual toner amount A is 50%, and the residual life B of the photosensitive drum is 45%. Therefore, the inequality: (residual life B of photosensitive drum)<(residual toner amount A−residual toner amount detection interval extension margin C) is not satisfied. Thus, the residual toner amount detection management section 22 determines that the residual toner amount needs to be detected, and the CPU 205 detects the residual toner amount.

Further, the CPU 205 determines, through the residual toner amount detection management process, that the value of the residual toner amount detection interval threshold Wth is Fth (50%)=12.5%, and replaces the value of the referential toner consumption amount Wb with the value (=50%) of the current cumulative toner consumption amount Wint.

From this point in time on, the CPU 205 repeats this process, and as the value of (residual toner amount A estimated next−(Wint−Wb)) reaches 37.5% (cumulative toner consumption amount Wint is 62.5%), the CPU 205 determines whether or not it is the time for the residual toner amount detection, based on the residual life of the photosensitive drum and the residual toner amount.

In the case of the example shown in FIG. 10, the residual toner amount detection interval between Point 1 in time and Point 2 in time is 25%, which is substantially longer than 18.75% in the conventional method shown in FIG. 6.

As described above, also in this embodiment, the timing with which the residual toner amount is to be detected is adjusted according to the relationship between the residual life of the photosensitive drum and the residual toner amount in the cartridge 22. With this practice, it is possible to reduce the overall number of times the residual toner amount is detected in the image forming apparatus (overall number of times residual toner amount is detected before cartridge 22 reaches end of its life), and also, it is only when it is absolutely necessary that the residual toner amount is detected. That is, the residual toner amount is detected with such interval that makes it possible to predict the timing of the expiration of the life of the cartridge 22 at a satisfactory level of accuracy.

As described above, in this embodiment, if the CPU 205 determines that it is not because the cartridge 22 runs out of toner that the cartridge 22 reaches the end of its life, the CPU 205 extends the interval with which the residual toner amount is detected. With this practice, it is possible to reduce the number of times the residual toner amount is detected, and therefore, it is possible to prevent the problem that the image forming apparatus is increased in the amount of downtime by the detection of the residual amount of toner, and also, the problem that because the residual amount of toner is detected more times than absolutely necessary, the cartridge is unnecessarily reduced in the length of its life.

Embodiment 3

Next, the third preferred embodiment of the present invention is described. What is going to be primarily described here are the structural components of the image forming apparatus in this embodiment, which are different from the counterparts in the first and second embodiments. That is, the structural components of the image forming apparatus in this embodiment, which are similar to the counterparts in the first and second embodiments, are not going to be described.

(Residual Toner Amount Detection Management Section)

Figure 12:
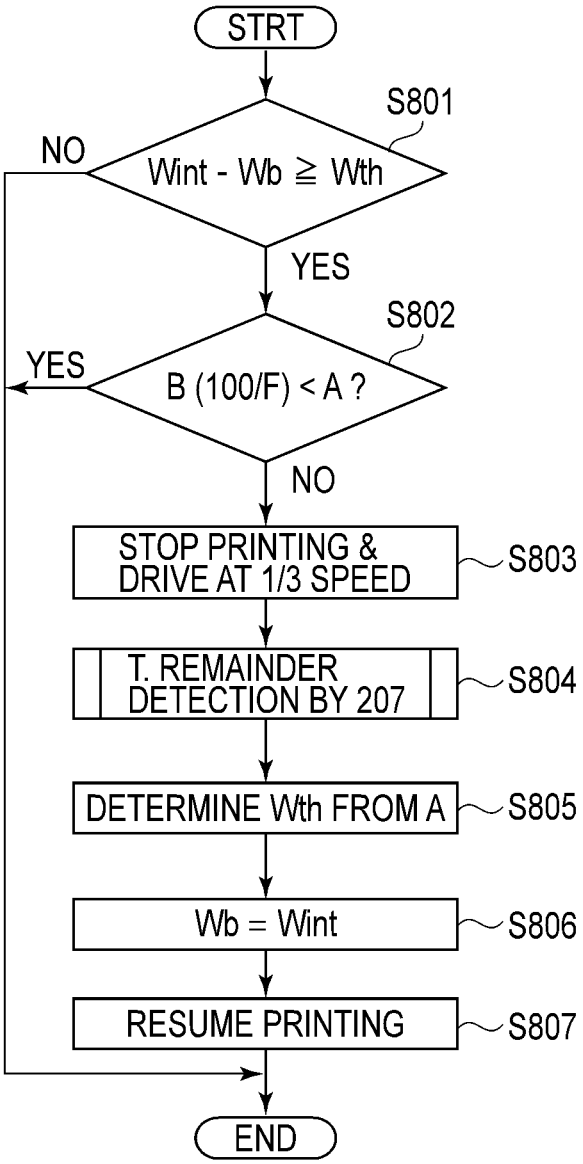
FIG. 12 is a drawing for describing the residual toner amount detection management process in the third embodiment.

FIG. 12 is a drawing for describing the residual toner amount detection management process, which is one of the characteristic features of this embodiment and is to be carried out by the residual toner amount detection management section 222. In the following description of this subject, the residual toner amount detection management process carried out for only one of the cartridges is described in order to make the description simpler.

The CPU 205 makes the image forming apparatus carry out a printing operation, and each time the cumulative residual toner consumption amount Wint is renewed, it makes the residual toner amount detection management section 222 carry out the residual toner amount detection management process shown in FIG. 12.

The residual toner amount detection management section 222 compares the value of the residual toner amount detection interval threshold Wth, which was obtained when the residual toner amount was detected last time, with the difference between the referential toner consumption amount Wb (which is cumulative toner consumption amount at point in time when residual toner amount was detected last time) and current cumulative toner consumption amount Wint. Then, it determines whether or not the difference between the referential toner consumption amount Wb and cumulative toner consumption amount Wint is no less than the value of the residual toner amount detection interval threshold Wth (S801). If the difference between the referential toner consumption amount Wb and cumulative toner consumption amount Wint is no more than the value of the threshold Wth, the CPU 205 does not detect the residual amount of toner in the cartridge, and ends the residual toner amount detection management process (S801).

If the above-described value is no less than the value of the residual toner amount detection interval threshold Wth, the residual toner amount detection management section 222 determines whether or not the inequality: ((residual life B of photosensitive drum)×(100/estimated printing ratio F))<(residual toner amount A) is satisfied (S802).

(Residual life B of photosensitive drum)×(100/estimated printing ratio F) is the ratio of the estimated amount by which the toner (developer) in the cartridge 22 will be used before the photosensitive drum reaches the end of its residual life B, assuming that printing ratio is high at 100%, relative to the maximum toner capacity of the toner storage 301. The estimated printing ratio F is the value preset in the cartridge NVRAM 307 based on the estimated average printing ratio of a user. It is 10%, for example.

Figure 11:
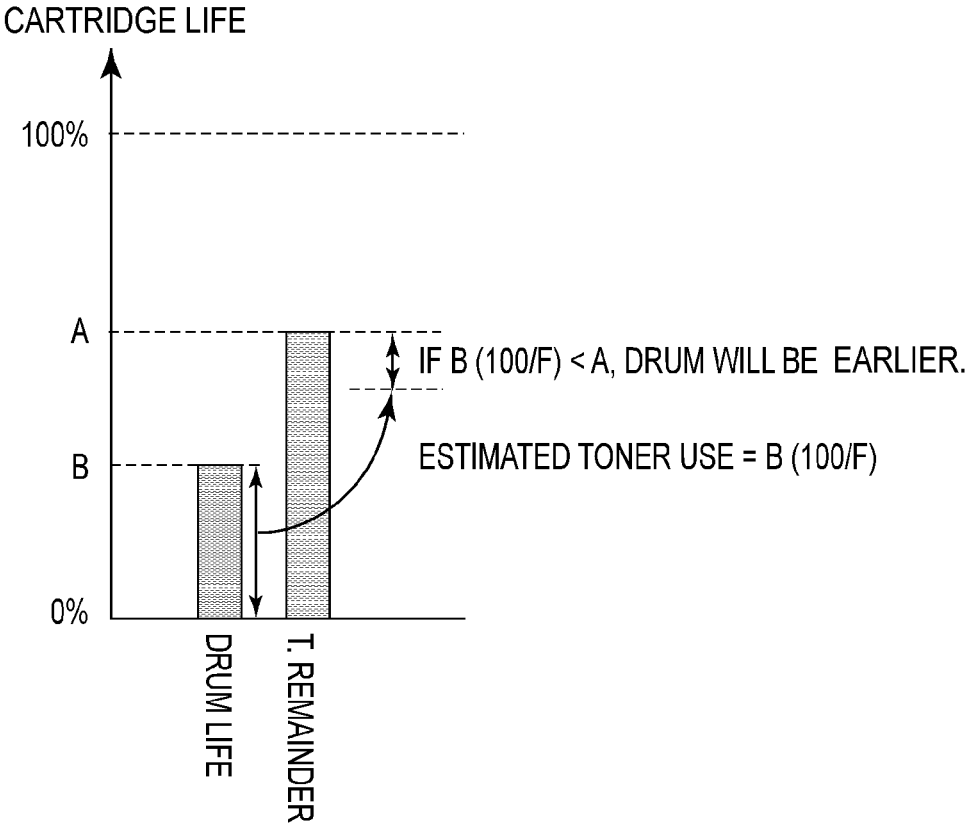
FIG. 11 is a drawing for describing the length of the service life of the process cartridge in the third preferred embodiment of the present invention.

In S802, it is determined whether the cartridge reaches the end of its life before the photosensitive drum in the cartridge reaches the end of its life, if the on-going printing operation is continued at the high printing ratio (100%), as shown in FIG. 11, which is a drawing for describing the residual life B of the cartridge 22. Incidentally, the value at which the printing ratio is assumed to be has only to be no less than the estimated average printing ratio of the user. However, it is preferable that it is set to 100% as in this embodiment.

If the residual toner amount detection management section 222 determines in S802 that the inequality: (residual life B of photosensitive drum)×(100/estimated printing ratio F))<(residual toner amount A) is satisfied, that is, if it determines that even if the on-going printing operation is continued at a high printing ratio, it does not occur that the cartridge reaches the end of its life because the cartridge runs out of the toner therein, it does not detect the residual toner amount, and ends the residual toner amount detection management process.

If the residual toner amount detection management section 222 determines in S802 that the inequality: (residual life B of photosensitive drum)×(100/estimated printing ratio F))<(residual toner amount A) is not satisfied, it determines that the residual toner amount needs to be detected.

As the CPU 205 determines that the residual toner amount needs to be detected, it interrupts the on-going printing operation to detect the residual toner amount, and begins to drive the developing device driving motor 211 at the speed for the residual toner amount detection (S803). As it begins to rotate the toner stirring member 305 by driving the developing device driving motor 211, it commands the residual toner amount detecting section 207 to detect the residual toner amount.

The residual toner amount detections 207 calculates the residual toner amount A by carrying out the above described residual toner amount detecting process, and sends the calculated residual toner amount A to the CPU 205 (S804).

As the residual toner amount detection management section 222 receives the residual toner amount A from the residual toner amount detecting section 207 by way of the CPU 205, it obtains the value of the residual toner amount detection interval threshold Wth with the use of Formula (2) (S805). Then, it replaces the value of the referential toner consumption amount Wb with the value of the current cumulative toner consumption amount Wint (S806).

As the CPU 205 completes the process for detecting the residual toner amount, it restores the driving speed of the developing device driving motor 211 from the one to which the speed was switched in S803, to the normal speed for a printing operation. Then, it restarts the interrupted printing operation, ending thereby the residual toner amount detection management process (S807).

In this embodiment, the amount by which the toner will be used if the printing ratio is high is derived. Therefore, it is possible to determine whether or not the cartridge reaches the end of its life not because it runs out of the toner, but because its photosensitive drum reaches the end of its life. That is, if the residual amount of toner in the cartridge is large enough to outlast the photosensitive drum in the cartridge, it is unlikely for the image forming apparatus to output an image which suffers from unwanted white spots attributable to toner shortage, and therefore, it is reasonable to determine that it is unnecessary to precisely determine the residual amount of toner in the cartridge. Therefore, the optical method for detecting the residual toner amount is not carried out.

(Example of Residual Toner Amount Detection Management Operation)

Figure 13:
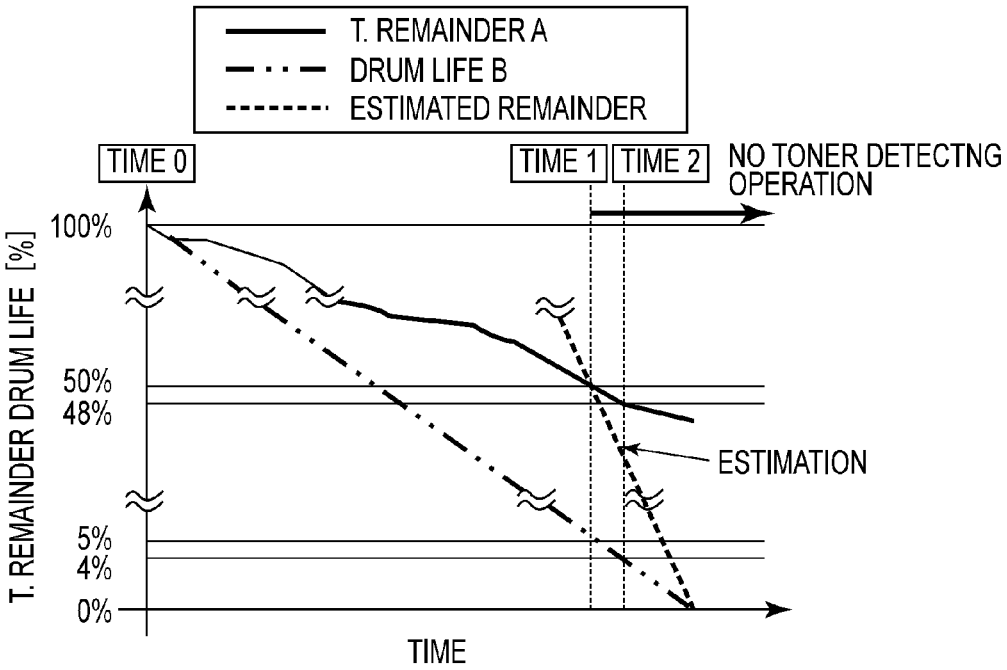
FIG. 13 is a drawing for describing the timing with which the residual toner amount is detected in the third embodiment.

Next, referring to FIG. 13, how and why the timing with which the residual toner amount is detected is delayed through the above-described residual toner amount management process is described.

FIG. 13 is a drawing which shows the changes in the residual toner amount, changes in the residual life of the photosensitive drum, and timing with which the residual toner amount is detected. For the simplification of the following description of the residual toner amount detection management process in this embodiment, it is assumed that there is no difference between the residual toner amount estimated based on the output of the residual toner consumption estimating section 208, and the actual residual toner amount; the two are virtually the same.

With the elapse of time, the CPU 205 repeats an image forming operation. Each time an image is formed, the CPU 205 receives the toner consumption amount W outputted by the toner consumption amount estimating section 208, and estimates the residual toner amount.

The CPU 205 carries out the residual toner amount detection management process at Point 1 in time. At Point 1 in time, the residual toner amount is 50%, and the residual life B of the photosensitive drum is 5%. Further, the printing ratio F has been estimated to be 10%.

Thus, if the difference between the referential toner consumption amount Wb and cumulative residual toner amount Wint is no less than the value of the residual toner amount detection threshold Wth, the inequality: ((residual life B of photosensitive drum)×((100/estimated print ratio F))<(residual toner amount A) is not satisfied in S802 in FIG. 12. Thus, the residual toner amount detection management section 222 determines that the residual toner amount has to be detected, and detects the residual toner amount.

Next, the CPU 205 carries out the residual toner amount detection management process at Point 2 in time in FIG. 12. At Point 2, the residual toner amount is 48%, and the residual life B of the photosensitive drum is 4%. Further, the printing ratio F has been estimated to be 10%. Thus, if the difference between the referential toner consumption amount Wb and cumulative residual toner amount Wint is no less than the value of the residual toner amount detection threshold Wth, the inequality: ((residual life B of photosensitive drum)×(100/estimated print ratio F))<(residual toner amount A) is satisfied in S802 in FIG. 12. Thus, the residual toner amount detection management section 222 determines that the residual toner amount does not need to be detected.

That is, in the case shown in FIG. 13, the residual toner amount detection management section 222 determines that the residual toner amount does not need to be detected beyond Point 1 in time.

Also in this embodiment, the timing with which the residual toner amount is to be detected is adjusted based on the relationship between the residual life of the photosensitive drum and the residual toner amount, as described above. Thus, the same effects as those obtained by the second embodiment can be obtained also by this embodiment.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 052070/2011 filed Mar. 9, 2011 which is hereby incorporated by reference.

What is claimed is:

1. An image forming apparatus comprising:

a cartridge detachably mountable to a main assembly of the image forming apparatus, said cartridge including a developer accommodating portion for accommodating a developer, and an operation member;

a remaining amount detector for detecting a remaining amount of the developer in said developer accommodating portion when an image forming operation is not carried out while said operation member is in operation;

an operation amount detector for detecting a cumulative operation amount of said operation member; and a setting device for setting, on the basis of the remaining amount of developer detected by said remaining amount detector and the cumulative operation amount of said operation member detected by said operation amount detector, timing of subsequent remaining amount detection of said remaining amount detector, wherein said remaining amount detector provides a remaining amount ratio of the developer remainder to a maximum accommodation capacity of said developer accommodating portion, said operation amount detector provides an operation amount ratio of a remaining operation amount until an end of the service life from the detection of said cumulative operation amount to a total operation amount until the end of the service life from an initial state of said operation member, and said setting device sets the timing on the basis of a comparison between the remaining amount ratio and the operation amount ratio.

2. An apparatus according to claim 1, wherein the end of the service life of said cartridge is discriminated when said remaining amount detector detects that the remaining amount of developer becomes less than a predetermined amount, or the end of the service life of said cartridge is discriminated when said operation amount detector detects the end of the service life of said operation member.

3. An apparatus according to claim 2, wherein when the remaining amount ratio is larger than the operation amount ratio, said setting device sets the timing to be later than a predetermined timing.

4. An apparatus according to claim 2, wherein when the remaining amount ratio is smaller than the operation amount ratio, said remaining amount detector detects the remaining amount at a timing preset by said setting device.

5. An apparatus according to claim 1, wherein said operation member is a photosensitive drum, and said operation amount detector detects a total number of rotations of said photosensitive drum as the cumulative operation amount.

* * * * *